US005701631A

United States Patent [19]

Lindquist

[11] Patent Number: 5,701,631

[45] Date of Patent: Dec. 30, 1997

[54] COOLING ARRANGEMENT FOR POWER COMPONENTS IN A VACUUM CLEANER

[75] Inventor: Tommy Lindquist, Farsta, Sweden

[73] Assignee: Aktiebolaget Electrolux, Stockholm, Sweden

[21] Appl. No.: 736,530

[22] Filed: Oct. 24, 1996

[30] Foreign Application Priority Data

Oct. 25, 1995 [SE] Sweden ..... 9503753

[51] Int. Cl.[6] ..... A47L 9/28

[52] U.S. Cl. ..... 15/327.1; 15/339; 15/413

[58] Field of Search ..... 15/339, 412, 327.1, 15/413

[56] References Cited

U.S. PATENT DOCUMENTS

| | | | |
|---|---|---|---|
| 2,817,358 | 11/1957 | Beede et al. | 15/327.7 X |
| 3,083,396 | 4/1963 | Senne et al. | 15/327.7 X |
| 3,172,743 | 3/1965 | Lowalewski | 15/339 X |
| 3,510,904 | 5/1970 | Lagerstrom | 15/319 |
| 4,809,398 | 3/1989 | Linduist . | |

FOREIGN PATENT DOCUMENTS

| | | |
|---|---|---|
| 4212643 | 10/1993 | Germany . |
| 2-131732 | 5/1990 | Japan . |
| 349742 | 10/1969 | Sweden . |

*Primary Examiner*—Chris K. Moore

*Attorney, Agent, or Firm*—Pearne, Gordon, McCoy & Granger LLP

[57] ABSTRACT

A vacuum cleaner having a housing (10) in which is disposed an electric circuit, a motor-fan unit (14), and a dust container (12). The dust container is received in a chamber (11). The chamber is provided with an opening (16) through which the dust container can be removed from the chamber. The opening is normally closed by a cover (17). The cover (17) is provided with a heat-transmitting surface which is thermally connected to at least one heat-generating power component (42) disposed in the cover.

17 Claims, 2 Drawing Sheets

COOLING ARRANGEMENT FOR POWER COMPONENTS IN A VACUUM CLEANER

BACKGROUND OF THE INVENTION

The present invention relates to a vacuum cleaner having a housing which is provided with an electric circuit, a motor-fan unit, and a chamber for a dust container, wherein the chamber is provided with an opening through which the dust container can be removed from the chamber, and wherein the opening is normally closed by a cover.

An electric circuit for vacuum cleaners of the above-mentioned type usually include different types of heat generating power components such as, for instance, start-up resistors or triacs, to control the speed of the motor. These power components, which generate a substantial amount of heat, are usually placed in close proximity to the motor-fan unit, and downstream of the motor-fan unit as seen in the direction of air flow. Sometimes, integrated circuit boards are used, and the power components are disposed on the integrated circuit boards to facilitate assembly. In this regard see, for example, European Patent No. EP 365797.

Positioning the electric components behind the motor-fan unit means that the electric components will not be cooled in an efficient manner since the air flow is also used to cool the electric motor of the motor-fan unit and, hence, will be heated up before it reaches the electric components. Since the power of electric motors for vacuum cleaners has been gradually increased, it has been necessary to enlarge the area of the cooling surfaces for the power components in order to efficiently cool the power components. It has also been necessary to use components which are highly specialized and adapted to operate in elevated temperatures due to the unreliable cooling provided by locating the power components downstream of the motor-fan unit. These requirements have therefore increased the costs associated with the power components and the vacuum cleaners in which the power components are used.

In order to effectively cool a vacuum cleaner power component it has also been suggested, see DE-A-4212643, to put the component in the relatively cooler air flow on the inlet side of the fan, and by means of an electric conductor, connect the component with an integrated circuit board which is placed downstream of the fan, as seen in the direction of air flow. A similar arrangement is also described in Swedish Patent No. 349742, wherein the heat-sensitive components are placed on a heat-transmitting plate located close to the dust container. However, these arrangements suffer from the disadvantages that assembling the components and connecting them to the other electric equipment is complicated.

It has also been suggested, see Japanese Patent No. JP 63-283671, to use optical sensors in vacuum cleaners to sense the type of dust bag being used therein and, depending upon the sensed type of dust bag, to control the motor of the vacuum cleaner so that motor works under optimal conditions. The sensor is arranged in the cover belonging to the chamber in which the dust bag is placed. It should be noted that this arrangement does not, however, relate to a power component, but rather to a single electric component which has been placed in a suitable position in the vacuum cleaner solely for the purpose of sensing the type of dust bag being used therein.

SUMMARY OF THE INVENTION

It is a purpose of the present invention to remove at least some of the deficiencies present in the above-described art, and to provide an arrangement wherein heat-generating components of the vacuum cleaner are disposed in a position wherein they are efficiently cooled by incoming filtered air prior to the air passing over the motor-fan device. It is a further purpose of the present invention to provide a mounting arrangement for an integrated circuit within a cover of the vacuum cleaner housing wherein heat-generating components are disposed on the integrated circuit and located such that effective thermal cooling of the heat-generating components may be provided.

It is a further purpose of the present invention to achieve an arrangement which gives an effective cooling of heat-generating components, and hence, to make it possible to use less heat-tolerant and less expensive components. It is a further purpose of the present invention to facilitate assembly of the vacuum cleaner by mounting the electric components on the cover as a separate unit before the cover is mounted in the vacuum cleaner.

In accordance with the present invention, the cover is easily accessible and is positioned in the vacuum cleaner such that it can be connected to the other electric components by means of a minimal amount of conductors. Since the cover is placed close to or, alternatively, includes a sleeve to which the hose of the vacuum cleaner is connected, the establishment of the electric connection between a remote control placed on the tube handle of the vacuum cleaner and the motor of the vacuum cleaner is facilitated. The arrangement according to the present invention also has the advantage that the same cover can be provided with different electric components for different models of vacuum cleaners, thereby further reducing manufacturing costs. By means of the arrangement according to the present invention, a space behind the motor-fan unit, which heretofore has been occupied by electric equipment, can instead be used to hold filtration and/or sound reduction means.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
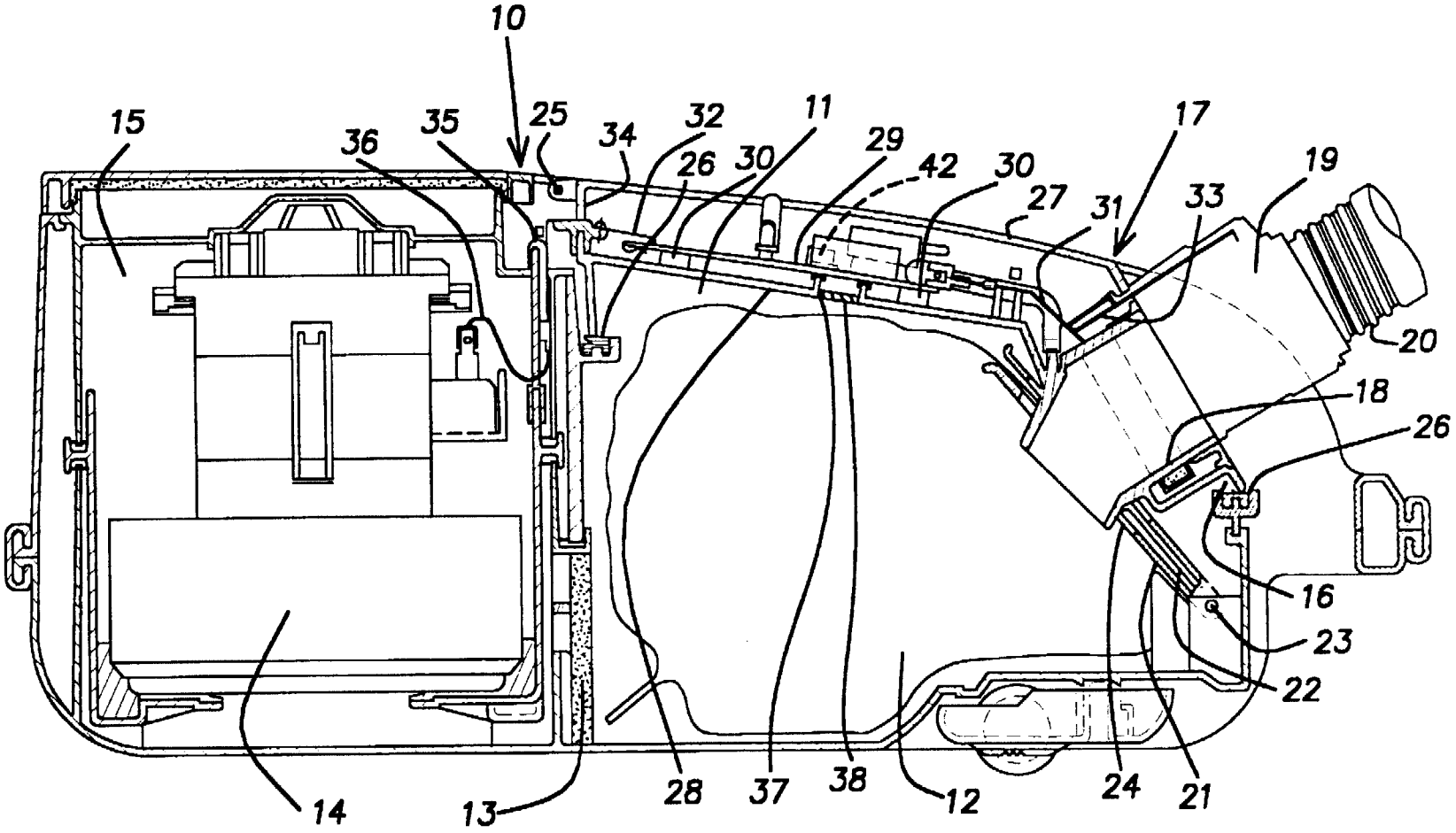
FIG. 1 is a vertical section through a vacuum cleaner which is provided with a device according to the invention.

The vacuum cleaner comprises a housing 10 that encloses a chamber 11 for a dust container 12 which, preferably, is an air-permeable paper bag. The chamber 11 communicates, via a filter 13, with an inlet side of a motor-fan unit 14 arranged in a rear part 15 of the vacuum cleaner. The chamber 11 has an opening 16 that is normally closed by a cover 17. The cover 17 is provided with a bent sleeve 18 to which an end part 19 of a flexible hose 20 can be connected. Near the sleeve 18, there is a holder 21 for a collar 22 which is a part of the dust container 12. The holder 21 is pivotally supported at 23, and has an opening 24 through which the end of the sleeve 18 protrudes when the cover 17 is in a closed position, as illustrated in FIG. 1. The cover 17 is supported by a hinge 25 and is sealed from the edges of the opening 16 by means of a sealing gasket 26. The cover 17 can, by means of a locking mechanism (not shown), be fixed in the closed position.

The cover 17, which preferably is made of plastic, has a hollow structure and comprises an outer wall part 27 and an inner wall part 28. An integrated circuit board 29 is disposed between the wall parts 27 and 28. The integrated circuit board 29 rests on supports 30 that extend upwardly or outwardly from the inner wall part 28, as illustrated. The integrated circuit board 29 is a part of the electric circuit of the vacuum cleaner and is provided with various desired electrical components, such as pressure sensors, switches, indicators, and power components for monitoring and controlling operation of the vacuum cleaner. The circuit(s) of the integrated circuit board 29, or the components thereon, are connected to contact means 31 and 32.

The contact means 31 is positioned or located such that, when the end part 19 of the hose 20 is fixed to the sleeve 18, the contact means 31 is in engagement with a plug 33. The plug 33 is electrically connected, via a conductor (not shown), to a remote control means, such as an on-off switch, arranged on the tube handle (not shown) to which the hose 20 is fixed.

The contact means 32 extend through a rear side wall 34 of the cover 17 and is, when the cover 17 is closed, in engagement with contact plates 35. The contact plates 35 are electrically connected, via conductors 36, to the electric motor of the motor-fan unit 14, as well as to conductors (not shown) for supplying electric energy to the vacuum cleaner. When the cover 17 is open, the contact means 32 is out of engagement with the contact plates 35, and no electric energy is supplied to the parts of the electric circuit which are placed in the cover 17.

Figure 2:
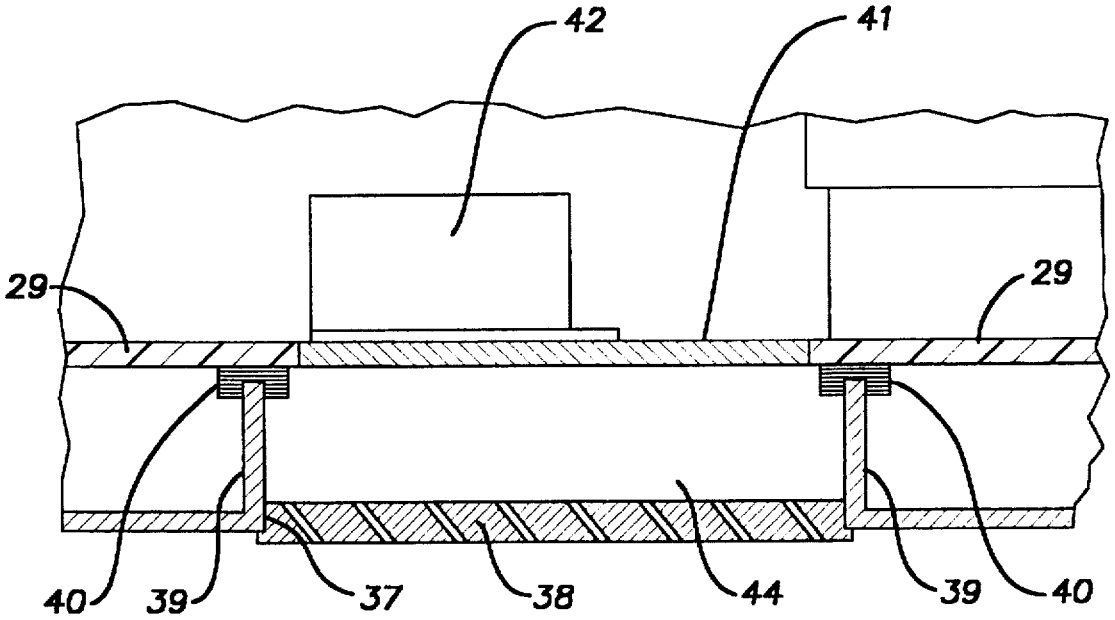
FIG. 2 is a vertical section in a larger scale of a portion of the vacuum cleaner.

With reference to FIG. 2, the inner wall part 28 has an opening 37 covered by a grating 38 which prevents a user from inadvertently touching the heated or hot surfaces above the grating 38. Between the opening 37 and the integrated circuit board 29, there is an annular or tube-shaped wall 39. The wall 39 is separated from the integrated circuit board by a sealing gasket 40. The circuit board 29 includes a heat-conductive metal plate 41 that extends into the area surrounded by the wall 39. The plate 41 cooperates with the wall 39 to define a compartment 44 that communicates with the chamber 11 via the opening 37 and grating 38. The plate 41 is thermally connected to one or more heat-generating power components 42 so that heat is easily conducted to the metal plate 41. The power component 42 may be a triac, a start-up resistor, or some other type of heat-generating device.

The cooling arrangement works in the following manner. Dust or dirt laden air is drawn into the chamber 11 through the hose 20 by operation of the motor-fan unit 14, and enters the dust container 12 wherein the dust is separated from the air. The air then flows through the air-permeable walls of the container 12, through the filter 13, and into the rear part 15 of the vacuum cleaner in the vicinity of the motor-fan unit 14. The relatively dust-free air thence flows through channels or openings in the rear part 15, and escapes to atmosphere. A portion of the air, after passing through the walls of the dust container 12, flows through the grating 38 and into the compartment 44 before exiting the chamber 11. The air, when passing the metal plate 41, takes up heat from the plate that has been thermally conducted from the power components 42 to the metal plate 41, thereby efficiently cooling the components. Tests have shown that a considerable temperature reduction is achieved by means of this arrangement.

While the preferred embodiment of the present invention is shown and described herein, it is to be understood that the same is not so limited but shall cover and include any and all modifications thereof which fall within the purview of the invention.

What is claimed is:

1. A vacuum cleaner comprising a housing (10) in which is disposed an electric circuit, a motor-fan unit (14), and a dust container (12), said dust container being received within a chamber (11) provided within the housing, the chamber being provided with an opening (16) through which the dust container is accessible, said opening normally being closed by a cover (17), wherein at least one heat generating power component (42) is disposed within said cover and the cover (17) includes a heat-transmitting surface (41) which is thermally connected to said at least one heat generating power component (42).

2. A vacuum cleaner according to claim 1, wherein the power component (42) is a triac.

3. A vacuum cleaner according to claim 1, wherein the power component (42) is a start-up resistor.

4. A vacuum cleaner according to claim 1, wherein the cover (17) includes an inner wall part (27) and an outer wall part (28), said wall parts being spaced a distance from each other and wherein an integrated circuit board with said power component (42) is disposed relatively between said wall parts.

5. A vacuum cleaner according to claim 4, wherein the cover includes a sleeve (18) to which a suction hose (20) is connected.

6. A vacuum cleaner according to claim 4, wherein the inner wall part (28) defines an air inlet opening (37), said air inlet opening communicating with a compartment (44), said compartment being at least partly limited by the heat-transmitting surface (41).

7. A vacuum cleaner according to claim 6, wherein the air inlet opening (37) is covered by a grating (38).

8. A vacuum cleaner according to claim 1, wherein said cover defines a compartment (44) which extends between said chamber and said heat-transmitting surface.

9. A vacuum cleaner according to claim 8, wherein said cover includes an inner wall part (28), said inner wall part defines an air inlet opening (37) for said compartment, said compartment being at least partly limited by the heat-transmitting surface (41).

10. A vacuum cleaner according to claim 9, wherein the air inlet opening (37) is covered by a grating (38).

11. A vacuum cleaner according to claim 9, wherein the cover (17) further includes an outer wall part (28), said inner and outer wall parts being spaced a distance from each other and an integrated circuit board with said power component (42) is disposed relatively between said wall parts.

12. A vacuum cleaner according to claim 11, wherein the air inlet opening (37) is covered by a grating (38).

13. A vacuum cleaner according to claim 12, wherein the cover includes a sleeve (18) to which a suction hose (20) is connected.

14. A vacuum cleaner according to claim 11, wherein the power component (42) is a triac.

15. A vacuum cleaner according to claim 11, wherein the power component (42) is a start-up resistor.

16. A vacuum cleaner according to claim 8, wherein the power component (42) is a triac.

17. A vacuum cleaner according to claim 8, wherein the power component (42) is a start-up resistor.

* * * * *